US010077690B2

(12) United States Patent
Choi

(10) Patent No.: US 10,077,690 B2
(45) Date of Patent: Sep. 18, 2018

(54) MULTIPLE VARIABLE VALVE LIFT APPARATUS

(71) Applicant: HYUNDAI MOTOR COMPANY, Seoul (KR)

(72) Inventor: Byong Young Choi, Bucheon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 70 days.

(21) Appl. No.: 15/248,805

(22) Filed: Aug. 26, 2016

(65) Prior Publication Data

US 2017/0152770 A1 Jun. 1, 2017

(30) Foreign Application Priority Data

Nov. 30, 2015 (KR) ..... 10-2015-0169033

(51) Int. Cl.

| | |
|---|---|
| ***F01L 1/34*** | (2006.01) |
| ***F01L 13/00*** | (2006.01) |
| ***F01L 1/08*** | (2006.01) |
| ***F01L 1/053*** | (2006.01) |

(52) U.S. Cl.

CPC ..... *F01L 13/0036* (2013.01); *F01L 1/0532* (2013.01); *F01L 1/08* (2013.01); *F01L 2013/0052* (2013.01); *F01L 2201/00* (2013.01)

(58) Field of Classification Search

CPC ..... F01L 13/0036; F01L 1/08; F01L 1/0532; F01L 2013/0052; F01L 2201/00

See application file for complete search history.

(56) References Cited

U.S. PATENT DOCUMENTS

| | | | | |
|---|---|---|---|---|
| 9,145,835 | B2 | 9/2015 | Stolk et al. | |
| 2012/0235777 | A1* | 9/2012 | Elendt ..... | F01L 13/0036 335/229 |

FOREIGN PATENT DOCUMENTS

| | | | |
|---|---|---|---|
| JP | 2014-517200 | A | 7/2014 |
| KR | 10-2014-0087368 | A | 7/2014 |

* cited by examiner

*Primary Examiner* — Zelalem Eshete

(74) *Attorney, Agent, or Firm* — Brinks Gilson & Lione

(57) ABSTRACT

A multiple variable valve lift apparatus may include a moving cam formed in a hollow cylindrical shape into which a camshaft is inserted. In particular, the moving cam rotates together with the camshaft, moves in an axial direction of the camshaft, and includes a cam guide protrusion and a plurality of cams realizing different valve lift with each other. Moreover, the apparatus includes: an operating unit selectively guiding the cam guide protrusion; a controller controlling the operating unit; a valve opening/closing unit contacting with any one cam of the cams; and at least two pins disposed at the operating unit so as to guide the cam guide protrusion. The cam guide protrusion includes an inserted portion being selectively inserted between the pins and a shift portion.

9 Claims, 6 Drawing Sheets

MULTIPLE VARIABLE VALVE LIFT APPARATUS

CROSS-REFERENCE TO RELATED APPLICATION

This application claims priority to and the benefit of Korean Patent Application No. 10-2015-0169033, filed on Nov. 30, 2015, which is incorporated herein by reference in its entirety.

FIELD

The present disclosure relates to a multiple variable valve lift apparatus. More particularly, the present disclosure relates to a multiple variable valve lift apparatus which realizes multiple valve lift by a simple structure.

BACKGROUND

The statements in this section merely provide background information related to the present disclosure and may not constitute prior art.

Generally, an internal combustion engine receives fuel and air into a combustion chamber and generates power by combusting the fuel and the air. An intake valve is operated by drive of a camshaft, and air flows into the combustion chamber while the intake valve is open. In addition, an exhaust valve is operated by drive of a camshaft, and air is exhausted from the combustion chamber while the exhaust valve is open.

Optimal operation of the intake valve/exhaust valve, however, depends on the RPM of the engine. That is, an appropriate time for lifting or opening/closing the valves depends on the RPM of the engine. In order to implement an appropriate valve operation in accordance with the RPM of the engine, as described above, a VVL (Variable Valve Lift) apparatus that operates valves at different lifts in accordance with the RPM of an engine has been studied.

Meanwhile, in a variable valve lift apparatus having a cam shift type which is configured that a plurality of cams are designed for driving a valve and the plurality of cams is moved along an axial direction, it is important that relative position between the plurality of cams and a valve opening/closing unit is exactly controlled.

In case that relative position between the plurality of cams and a valve opening/closing unit is not exactly controlled, interference is occurred between elements for guiding axial direction motion of the plurality of cams and the valve opening/closing unit or between the plurality of cams and the valve opening/closing unit. Thus, the valve opening/closing unit or the variable valve lift apparatus may be damaged, or reliability of a cam shift may be deteriorated.

SUMMARY

The present disclosure provides a multiple variable valve lift apparatus having advantages of improving reliability of a cam shift.

A multiple variable valve lift apparatus according to the present disclosure may include: a moving cam formed in a hollow cylindrical shape in which a camshaft inserted into the hollow, provided to rotate together with the camshaft and move in an axial direction of the camshaft, and configured to form a cam guide protrusion and a plurality of cams realizing different valve lift with each other; an operating unit selectively guiding the cam guide protrusion so as to move the moving cam in an axial direction; a controller controlling operations of the operating unit; a valve opening/closing unit contacting with any one cam of the plurality of cams so as to open/close a valve; and at least two pins disposed at the operating unit so as to guide the cam guide protrusion.

An inserted portion being selectively inserted between the pins and a shift portion formed so as to be guided between the pins of the operating unit may be formed at the cam guide protrusion, and the inserted portion may be formed to be thinner than the shift portion.

The shift portion may be formed to be gradually thick from the inserted portion.

Gaps between the pins may be formed to be equal to each other in case that the at least two pins are provided by three.

The moving cam may include a first moving cam moving in a first direction along an axial direction and a second moving cam moving in a second direction along an axial direction.

The operating unit may include a first operating unit being operated for operating the first moving cam and a second operating unit being operated for operating the second moving cam.

The cam guide protrusion formed at the first moving cam and the cam guide protrusion formed at the second moving cam may be formed in opposite directions in order to move the first moving cam and the second moving cam in the first direction or the second direction, respectively.

The first moving cam and the second moving cam may move together.

The operating unit may include a solenoid actuated under control of the controller, and the cam guide protrusions may be inserted between the pins so as to be guided when the pin is jutted by the solenoid.

The at least two pins may include a main pin being jutted depending on operations of the solenoid and at least one subordinate pin being engaged to the main pin so as to be jutted together with the main pin.

Gaps between the pins may be formed to be equal in case that the subordinate pins are provided by being more than two.

In another form, a multiple variable valve lift apparatus comprises:

- a moving cam into which a camshaft is inserted, the moving cam configured to rotate together with the camshaft and to move in an axial direction of the camshaft, wherein the moving cam comprises a cam guide protrusion and a plurality of cams configured, each of the cams configured to provide a different valve lift;
- an operating unit configured to selectively guide the cam guide protrusion so as to move the moving cam in the axial direction;
- a controller configured to control the operating unit;
- a valve opening/closing unit configured to contact with any one cam of the plurality of cams so as to open or close a valve; and
- a main pin and a subordinate pin disposed at the operating unit so as to guide the cam guide protrusion,
- wherein the cam guide protrusion comprises an inserted portion being selectively inserted between the main pin and the subordinate pin, and a shift portion being slanted relative to the inserted portion and configured to move the moving cam.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
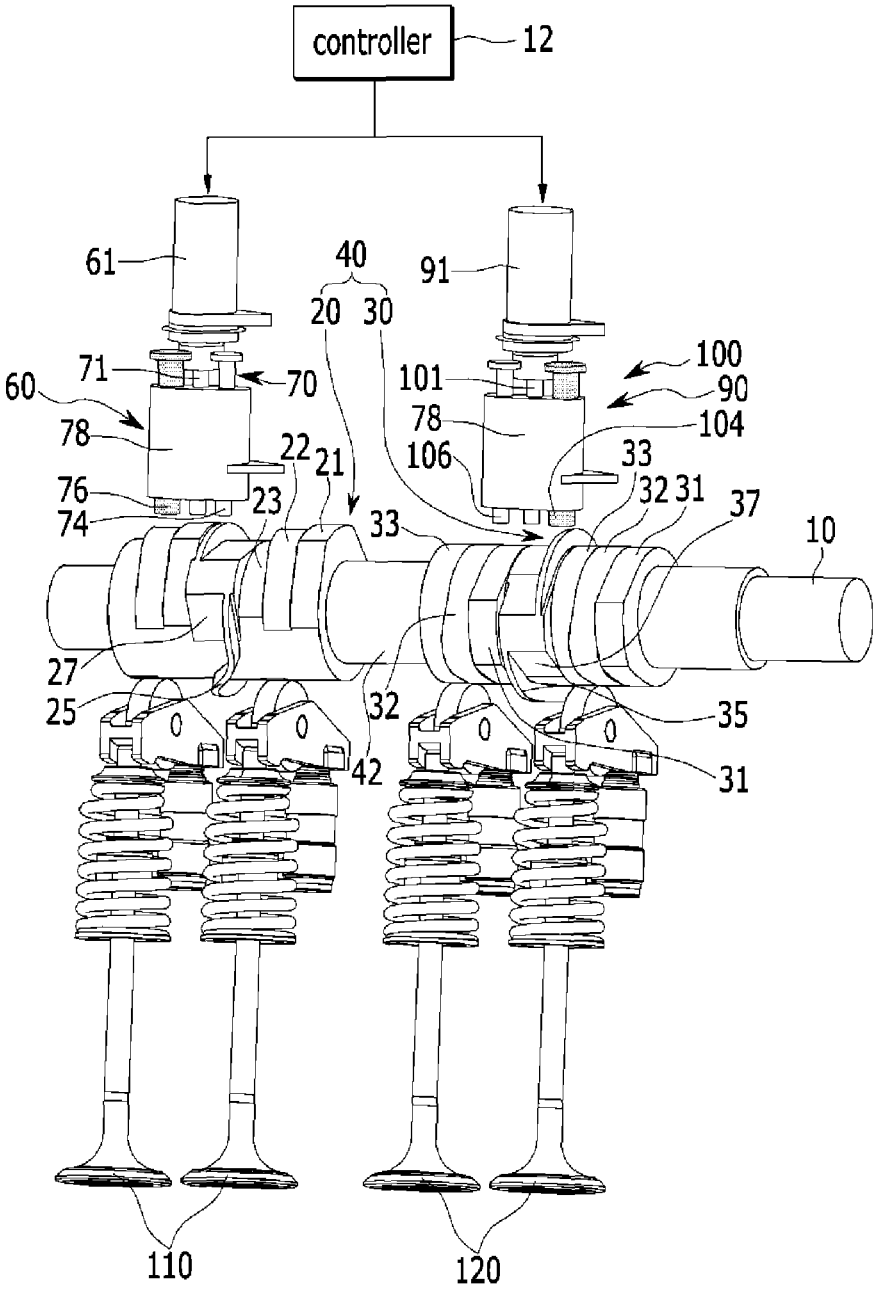
FIG. 1 is a perspective view of a multiple variable valve lift apparatus.

The drawings described herein are for illustration purposes only and are not intended to limit the scope of the present disclosure in any way.

<Description of symbols>

| | |
|---|---|
| 10: camshaft | 12: controller |
| 20: first moving cam | 21, 22, 23, 31, 32, 33: cam |
| 25: first cam guide protrusion | 25a: inserted portion |
| 25b: shift portion | 27, 37: sloped portion |
| 30: second moving cam | 35: second cam guide protrusion |
| 40: moving cam | 42: journal portion |
| 60, 90: first and second operating unit | |
| 61, 91: first and second solenoid | |
| 70, 100: first and second guide part | |
| 71, 101: main pin | |
| 74, 76, 104, 106: subordinate pin | |
| 78: pin housing | |
| 110, 120: valve opening/closing unit | |

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 is a perspective view of a multiple variable valve lift apparatus according to an exemplary embodiment of the present disclosure.

As shown in FIG. 1, a multiple variable valve lift apparatus includes: a camshaft 10; a first moving cam 20 including a plurality of cams 21, 22, and 23 having different shapes, having a first cam guide protrusion 25, rotating together with the camshaft 10, and being slidable in an axial direction of the camshaft 10; a second moving cam 30 including a plurality of cams 31, 32, and 33 having different shapes, having a second cam guide protrusion 35, rotating together with the camshaft 10, and being slidable in the axial direction of the camshaft 10; a first operating unit 60 selectively jutting out to guide the first cam guide protrusion 25 to move the first moving cam 20 in a first direction; a second operating unit 90 selectively jutting out to guide the second cam guide protrusion 35 to move the second moving cam 30 in a second direction; a controller 12 configured to control operations of the first operating unit 60 and the second operating unit 90; and valve opening and closing units 110 and 120 brought into contact with any one of the plurality of cams 21, 22, 23, 31, 32, and 33 so as to be opened and closed.

It is illustrated that the first moving cam 20 and the second moving cam 30 include three cams 21, 22, and 23, and 31, 32, and 33, respectively, but the present disclosure is not limited thereto, and the first moving cam 20 and the second moving cam 30 may have various numbers of cams.

The plurality of cams 21, 22, 23, 31, 32, and 33 may be disposed in order, sequentially starting from that having the largest valve lift, and any one of the cams, for example, the cams 23 and 33 may be cylinder deactivation cams having a cam lift of 0.

The first cam guide protrusion 25 and the second cam guide protrusion 35 are formed in the opposite directions in order to move the first moving cam 20 and the second moving cam 30 in the first direction and the second direction, respectively. For example, the first cam guide protrusion 25 may move the first moving cam 20 to the left in the drawing, and the second cam guide 35 may move the second moving cam 30 to the right.

The first and second operating units 60 and 90 include a corresponding solenoid (i.e., first and second solenoids 61 and 91, respectively) actuated under the control of the controller 12, and first and second guide parts 70 and 100 jutting out by the first and second solenoids 61 and 91 and allowing the first and second cam guide protrusions 25 and 35 to be inserted therein, respectively, in order to move the first and second moving cams 20 and 30.

The first and second operating units 60 and 90 further include a pin housing 78, respectively, and the first and second guide parts 70 and 100 further include main pins 71 and 101 rotatably provided in the pin housing 78 and jutting out according to actuations of the first and second solenoids 61 and 91, and subordinate pins 74, 76, 104, and 106 rotatably provided in the pin housing 78 and engaged with the main pins 71 and 101 so as to jut out together with the main pins 71 and 101.

In FIG. 1, one main pin 71, 101 and two subordinate pins 74, 76, 104, 106 are provided to one pin housing 78, but the number of the main pin 71, 101 and the subordinate pin 74, 76, 104, 106 are not limited thereto. The main pin 71, 101 and the subordinate pin 74, 76, 104, 106 may be provided in proportion to the number of the plurality of cams 21, 22, 23, 31, 32, and 33.

A sloped portion 27, 37 may be formed in the first and second moving cams 20 and 30, respectively, to allow the first and second guide parts 70, 100 to return to their original positions after the first and second moving cams 20, 30 are moved.

The first moving cam 20 and the second moving cam 30 may be connected to integrally move, and the first moving cam 20 and the second moving cam 30 may be integrally formed as a single moving cam 40. That is, the first cam guide protrusion 25 and the second cam guide protrusion 35 may move the moving cam 40 in the first direction or the second direction. In addition, a journal portion 42 is formed in a cylinder shape having an uniform radius so as to connect the first moving cam 20 with the second moving cam 30.

When the main pins 71 and 101 and the subordinate pins 74, 76, 104, and 106 jut out so the first and second cam guide protrusions 25 and 35 are inserted between the corresponding main pin (e.g., the main pin 71, 101) and subordinate pin (i.e., subordinate pin 74, 76, 104, 106), the first moving cam 20 and the second moving cam 30, or the moving cam 40, move in an axial direction of the camshaft 10, and the main pins 71 and 101 and the subordinate pins 74, 76, 104, and 106 may move along the sloped portions 27 and 37 so as to return to their original positions.

Figure 2:
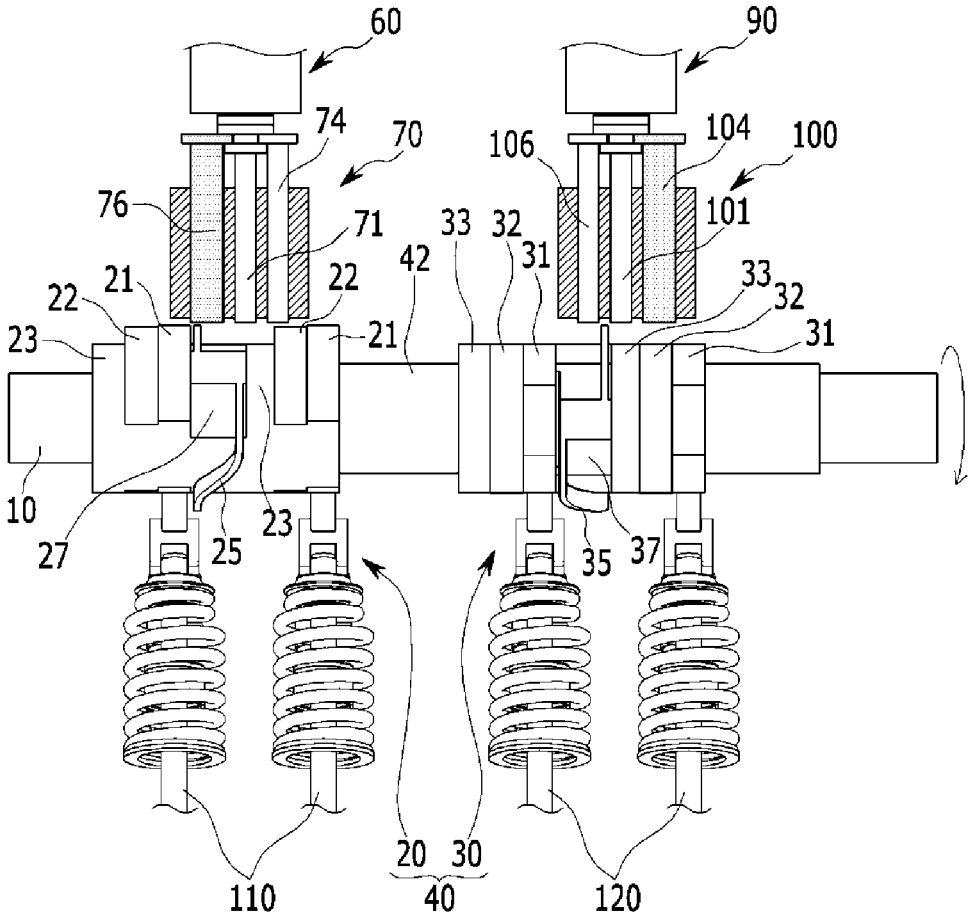
FIG. 2 to FIG. 4 are operational views of a multiple variable valve lift apparatus.
Figure 3:
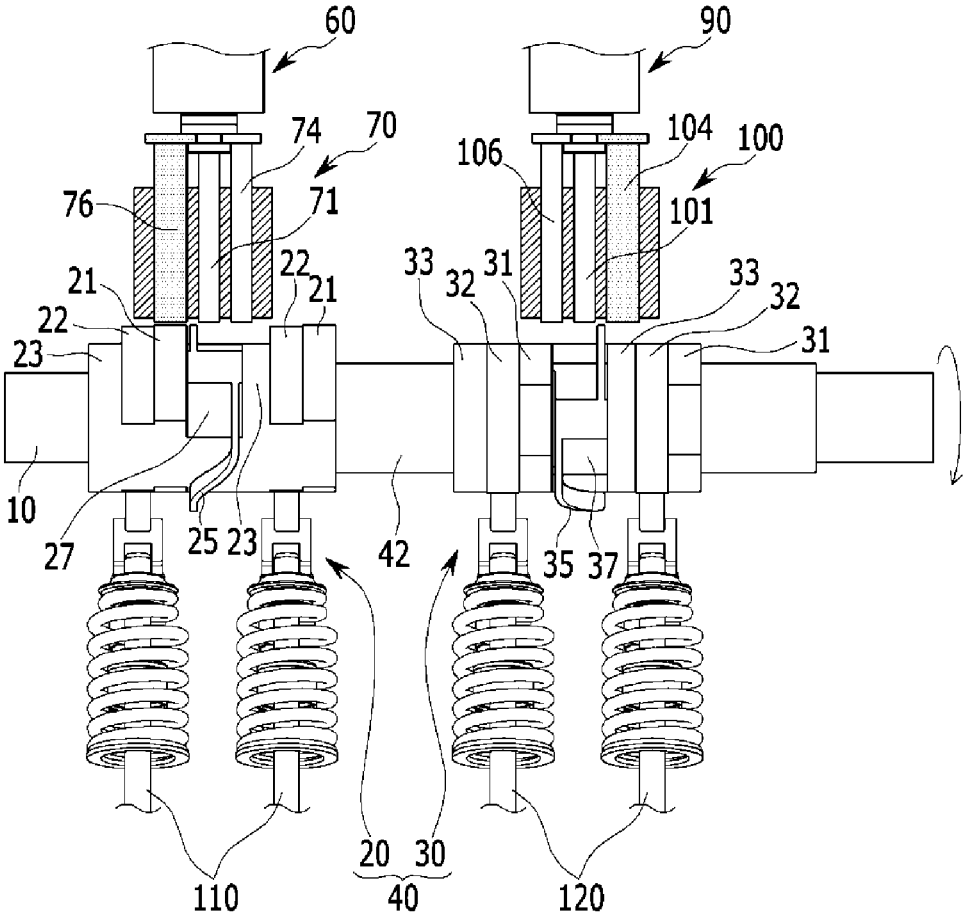
Figure 4:
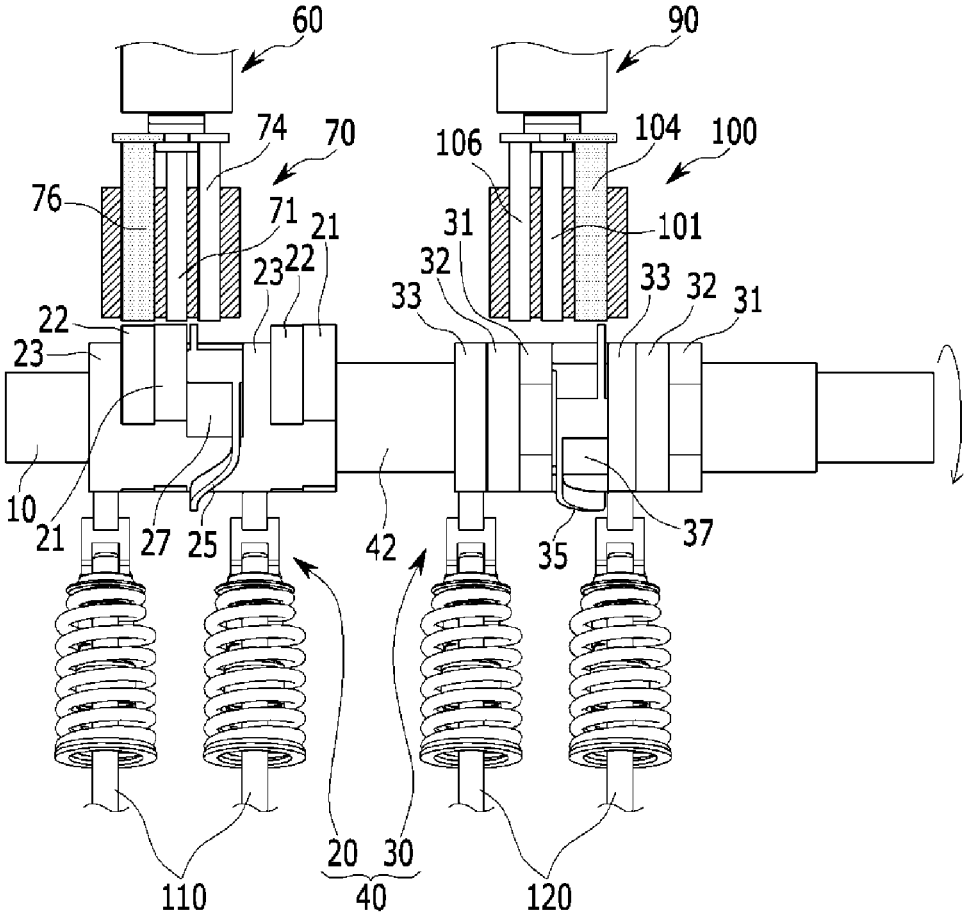

FIG. 2 to FIG. 4 are operational views of a multiple variable valve lift apparatus according to one form of the present disclosure.

As shown in FIG. 2, in a state in which the valve opening and closing units 110 and 120 are in contact with the right cams 21 and 31 among the cams, when a load of an engine is reduced, the controller 12 operates the second operating unit 90 and the second guide part 100 juts out. Thus, the second cam guide protrusion 35 is guided on the state of being inserted between the main pin 101 and the left subordinate pin 106 of the second guide part 100. Therefore, as illustrated in FIG. 3, the second moving cam 30 and the first moving cam 20 move toward the second direction which is the right in the drawing, and the valve opening and closing units 110 and 120 come into contact with the middle cams 22 and 32 among the cams so as to be opened and closed. Through this process, the valve lift is varied. Further, the second guide part 100 returns to its original position by the sloped portion 37 formed in the second moving cam 30.

In the state illustrated in FIG. 3, when the load of the engine is further reduced, the controller 12 operates the second operating unit 90 and the second guide part 100 juts out. Thus, the second cam guide protrusion 35 is guided on the state of being inserted between the main pin 101 and the right subordinate pin 104 of the second guide part 100. Subsequently, as illustrated in FIG. 4, the second moving cam 30 and the first moving cam 20 once more move toward the second direction which is the right in the drawing, and the valve opening and closing units 110 and 120 come into contact with the left cams 23 and 33 among the cams so as to be opened and closed. Through this process, the valve lift is varied. The second guide part 100 returns to its original position by the sloped portion 37 formed in the second moving cam 30.

In the state illustrated in FIG. 4, when the load of the engine is increased, the controller 12 operates the first operating unit 60 and the first guide part 100 juts out. A change of the valve lift by a movement toward the first direction of the moving cam 40 depending on the jutting of the first guide part 100 is similar to the above described change of the valve lift by the movement toward the second direction of the moving cam 40 though the moving cam 40 is operated in a reverse moving direction, so a detailed description thereof will be omitted.

In general, a space between cams is limited, but in the multiple variable valve lift apparatus according to the present disclosure, the first cam guide protrusion 25 and the second cam guide protrusion 35 have a plate shape, thus overcoming restrictions with respect to the axial directional space of the camshaft 10.

Figure 5:
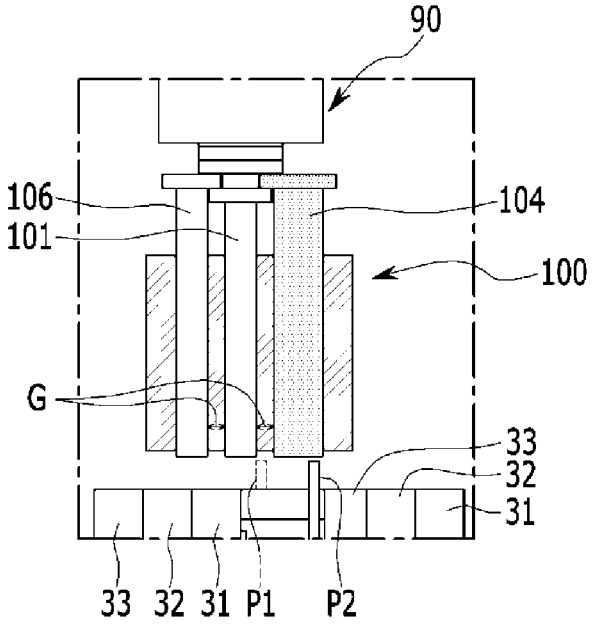
FIG. 5 is an enlarged view of an operating unit.

FIG. 5 is an enlarged view of an operating unit according to an exemplary embodiment of the present disclosure.

As shown in FIG. 5, one subordinate pin 104 of two subordinate pins 104, 106 which are disposed at the operating unit 90 has a large width along an axial direction of the camshaft 10 in comparison with the other one subordinate pin 106 and main pin 101. This configuration also applies to the subordinate pin 76 with respect to the subordinate pin 74 and main pin 71.

The one subordinate pin having the large width may be a left subordinate pin 76 of the first operating unit 60 being operated so as to move the moving cam 40 in the first direction (left in drawing) and a right subordinate pin 104 of the second operating unit 90 being operated so as to move the moving cam 40 in the second direction (right in drawing).

In case that the first solenoid 61 and the first operating unit 60 malfunction so that the first guide part 70 is jutted on the state that the a valve opening/closing unit 110 and 120 is contacted to a right cam 21 and 31 of the cams, the one subordinate pin 76 of the first operating unit 60 is blocked to the first cam guide protrusion 25 such that the first guide part 70 is not jutted no more. Therefore, it is inhibited that the moving cam 40 is moved more toward left by the first guide part 70 jutting on the state that the valve opening/closing unit 110 and 120 is contacted to the right cam 21 and 31 of the cams. As this, interferences between constituent elements such as an interference between the first cam guide protrusion 25 and the valve opening/closing unit 110 is inhibited as an excessive movement of the moving cam 40 is limited.

In case that the second solenoid 91 and the second operating unit 90 malfunction so that the second guide part 100 is jutted on the state that the a valve opening/closing unit 110 and 120 is contacted to a left cam 23 and 33 of the cams, the one subordinate pin 104 of the second operating unit 90 is blocked to the second cam guide protrusion 35 such that the second guide part 100 is not jutted no more. Therefore, it is inhibited that the moving cam 40 is moved more toward right by the second guide part 100 jutting on the state that the a valve opening/closing unit 110 and 120 is contacted to the left cam 23 and 33 of the cams. As this, interferences between constituent elements such as an interference between the second cam guide protrusion 35 and the valve opening/closing unit 120 is inhibited as an excessive movement of the moving cam 40 is limited.

Meanwhile, gaps G between the main pin 71, 101 and the each subordinate pins 71, 74, 101, 106 may be formed to be equal to each other. In FIG. 5, the position of the cam guide protrusion 25 and 35 before moving is shown by P1, and the position thereof after moving is shown by P2. The one subordinate pin 76, 104 having the large width is formed with an enough width such that the cam guide protrusion 25, 35 escapes from the one subordinate pin 76, 104 having the large width even when the moving cam 40 moves maximally toward the first direction (left in drawing) or the second direction (right in drawing).

Figure 6:
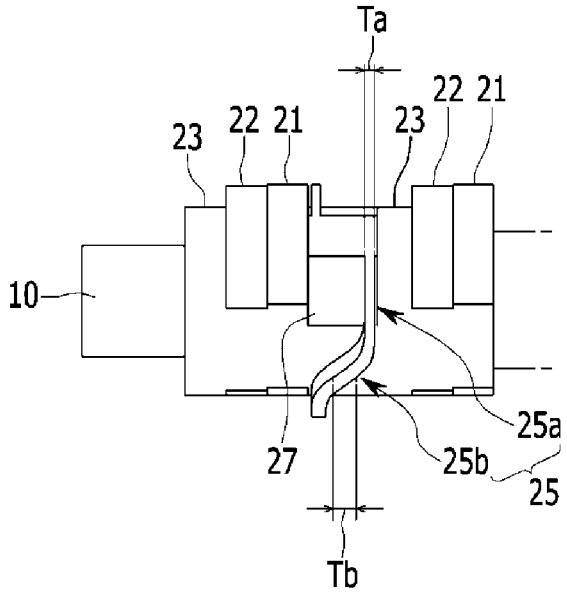
FIG. 6 is an enlarged view of a moving cam.

FIG. 6 is an enlarged view of a moving cam according to an exemplary embodiment of the present disclosure.

The first cam guide protrusion 25 being disposed at the first moving cam 20 is only shown in FIG. 6, but the second cam guide protrusion 35 being dispose at the second moving cam 30 is also applied with a same concept.

As shown in FIG. 6, the cam guide protrusion 25,35 includes: an inserted portion 25*a* being inserted between the main pin (e.g., 71,101) and the subordinate pin (e.g., 74, 76, 104, 106); and a shift portion 25*b* being slanted for moving the moving cam 40 along an axial direction of the camshaft 10.

A thickness of the inserted portion 25*a* is formed to be thinner than a thickness of the shift portion 25*b*. This is for easily inserting the inserted portion 25*a* between the main pin 71, 101 and the subordinate pin (e.g., 74, 76, 104, 106), and reducing the impact by that the shift portion 25*b* is contacted with the main pin 71 and 101 and the subordinate pin 74, 76, 104, and 106 when the moving cam 40 is moved along the axial direction of the camshaft 10.

For instance, if the thickness of the inserted portion 25*a* is 1.0 mm in case that the gap G between the main pin 71 and 101 and the subordinate pin 74, 76, 104, and 106 is 2.2 mm, a predetermined distance is formed by being 0.6 mm toward both sides with respect to the inserted portion 25*a* to the main pin 71 and 101 or the subordinate pin 74, 76, 104, and 106 on the state that the inserted portion 25*a* is inserted between the main pin 71, 101 and the subordinate pin 74, 76, 104, 106. This is for allowing operation error along the axial direction within the range of 0.6 mm when the inserted portion 25*a* is inserted. Meanwhile, if the thickness of the shift portion 25*b* is equal to or longer than 2.0 mm in case that the gap G between the main pin 71, 101 and the subordinate pin 74, 76, 104, 106 is 2.2 mm, a predetermined distance is formed by being equal to or shorter than 0.1 mm toward both sides with respect to the shift portion 25*b* to the main pin 71 and 101 or the subordinate pin 74, 76, 104, and 106 at the time of the cam shift. This is for reducing the impact at the time of the cam shift by reducing the distance toward both sides with respect to the shift portion 25*b* to the main pin 71 and 101 or the subordinate pin 74, 76, 104, and 106. Herein, a thickness of a thickest portion of the shift portion 25*b* may be 2.0 mm, and the shift portion 25*b* may be formed in a shape of being gradually increased from the inserted portion 25*a*.

According to the present disclosure, multiple valve lifts can be realized by a simple composition. In addition, an allowable range of the operation error may be provided and reliability of the cam shift may be improved as the predetermined distance is formed between the inserted portion 25*a* of the cam guide protrusion 25 and 35 and the pins 71, 74, 76, 101, 104, 106. Furthermore, the impact may be alleviated at the time of the cam shift as the predetermined distance is formed, to be shorter than the distance between the inserted portion 25*a* of the cam guide protrusion 25, 35 and the pin 71, 74, 76, 101, 104,106, between the shift portion 25*b* of the cam guide protrusion 25 and 35.

While this present disclosure has been described in connection with what is presently considered to be practical exemplary embodiments, it is to be understood that the present disclosure is not limited to the disclosed embodiments. On the contrary, it is intended to cover various modifications and equivalent arrangements included within the spirit and scope of the present disclosure.

What is claimed is:

1. A multiple variable valve lift apparatus comprising:

a moving cam formed in a hollow cylindrical shape in which a camshaft inserted into the moving cam, the moving cam configured to rotate together with the camshaft and to move in an axial direction of the camshaft, wherein the moving cam comprises a cam guide protrusion and a plurality of cams configured to perform a different valve lift with each other;

an operating unit configured to selectively guide the cam guide protrusion so as to move the moving cam in the axial direction;

a controller configured to control the operating unit;

a valve opening/closing unit configured to contact with any one cam of the plurality of cams so as to open or close a valve; and at least two pins disposed at the operating unit so as to guide the cam guide protrusion, wherein an inserted portion being selectively inserted between one of said at least two pins and a shift portion formed so as to be guided between said at least two pins of the operating unit is formed at the cam guide protrusion, and the inserted portion is formed to be thinner than the shift portion.

2. The apparatus of claim 1, wherein the shift portion is formed to be gradually thick from the inserted portion.

3. The apparatus of claim 1, wherein gaps between said at least two pins are formed to be equal to each other in case that said at least two pins are provided by three.

4. The apparatus of claim 1, wherein the moving cam comprises a first moving cam moving in a first direction along an axial direction and a second moving cam moving in a second direction along an axial direction, and the operating unit comprises a first operating unit configured to operate the first moving cam and a second operating unit configured to operate the second moving cam.

5. The apparatus of claim 4, wherein the cam guide protrusion formed at the first moving cam and the cam guide protrusion formed at the second moving cam are formed in an opposite direction in order to move the first moving cam and the second moving cam in the first direction or the second direction, respectively.

6. The apparatus of claim 4, wherein the first moving cam and the second moving cam is configured to move together.

7. The apparatus of claim 1, wherein the operating unit comprises a solenoid actuated under control of the controller, and the cam guide protrusions are inserted between said at least two pins so as to be guided when one of said at least two pins is jutted by the solenoid.

8. The apparatus of claim 7, wherein the at least two pins comprise a main pin being jutted depending on operation of the solenoid, and at least one subordinate pin being engaged to the main pin so as to be jutted together with the main pin.

9. The apparatus of claim 8, wherein the operating unit comprises at least two subordinate pins and a main pin, and gaps between the main pin and said at least two subordinate pins are formed to be equal.

* * * * *